United States Patent [19]

Mage

[11] Patent Number: 4,788,109

[45] Date of Patent: Nov. 29, 1988

[54] THREE-DIMENSIONAL DISPLAY DEVICE FOLDED FROM A SINGLE SHEET OF MATERIAL

[76] Inventor: Allen B. Mage, 5113 Baltimore St., Los Angeles, Calif. 90042

[21] Appl. No.: 90,532

[22] Filed: Aug. 28, 1987

Related U.S. Application Data

[63] Continuation-in-part of Ser. No. 886,652, Jul. 18, 1986, Pat. No. 4,708,911.

[51] Int. Cl.[4] ..... A63H 33/16

[52] U.S. Cl. ..... 428/542.8; 428/12; 493/405; 493/955

[58] Field of Search ..... 493/405, 394, 955, 956; 156/211, 227, 257; 428/12, 542.8

[56] References Cited

U.S. PATENT DOCUMENTS

| | | | |
|---|---|---|---|
| 2,333,569 | 11/1943 | Higgins | 493/405 X |
| 2,382,746 | 8/1945 | Price | 493/956 X |
| 3,207,357 | 9/1965 | Schmitt | 428/542.8 X |
| 3,267,597 | 8/1966 | Jannes | 428/12 X |
| 3,666,607 | 5/1972 | Weissman | 493/394 X |
| 3,878,638 | 4/1975 | Benjamin | 428/187 X |
| 4,001,964 | 1/1977 | Hooker | 428/9 X |
| 4,021,950 | 5/1977 | Asija | 428/542.8 X |
| 4,084,015 | 4/1978 | Patterson | 428/542.8 X |
| 4,227,334 | 10/1980 | Hooker | 428/542.8 X |
| 4,517,251 | 5/1985 | Mosely | 428/542.8 |

*Primary Examiner*—Henry F. Epstein
*Attorney, Agent, or Firm*—Robert J. Schaap

[57] ABSTRACT

A decorative display device which is capable of being folded from a relatively flat single sheet of material into a three-dimensional object. The sheet of material is embossed on its flat front face such that embossed segments project outwardly beyond the surface of the sheet with respect to non-embossed segments. In one embodiment, the sheet of material can serve as a poster or similar single sheet art decorative item. When folded and properly assembled, the sheet becomes a three-dimensional display device with embossed segments projecting beyond the non-embossed segments. A design on the face of the sheet cooperates with the segments such that the design on the flat sheet is re-created when the sheet is folded into a three-dimensional display device. Thus, the surface contour of the device conforms to and cooperates with the design on the sheet of material. In a preferred embodiment, a flag having a plurality of stripes may constitute the design on the sheet of material, and when folded into the three-dimensional display device, the stripes co-act with the embossed and non-embossed segments.

18 Claims, 3 Drawing Sheets

THREE-DIMENSIONAL DISPLAY DEVICE FOLDED FROM A SINGLE SHEET OF MATERIAL

RELATED APPLICATION

This application is a continuation-in-part of my copending U.S. patent application Ser. No. 886,652, filed July 18, 1986 U.S. Pat. No. 4,708,911, and entitled "Three-Dimensional Display Device Folded from a Single Sheet of Material".

BACKGROUND OF THE INVENTION

1. Field of the Invention

This invention relates in general to certain new and useful improvements in three-dimensional decorative display devices and more particularly, to three-dimensional decorative display devices which are capable of being folded from a single sheet of foldable material into such three-dimensional form and which sheet of material has a pattern or design with embossed segments conforming to and cooperating with the surface contour of the display device when formed.

2. Brief Description of the Prior Art

There have been numerous decorative display devices and other forms of devices in the prior art which can be folded from a single sheet of paper or similar material into a three-dimensional object. For example, children's craft toys often contain sheets of paper or paperboard material having fold lines to identify regions to be folded and possibly score lines to identify regions to be cut and/or removed. These fold lines and score lines thereby provide some guidelines and in effect, instructions which enable a child to fold the sheet of material into a three-dimensional object.

Heretofore, there has not been any single sheet of foldable material which has a design on the exterior surface and which can be folded into a three-dimensional display device with a major portion of the design conforming to and cooperating with a contour of the device which is formed, to thereby provide an aesthetically pleasing and useful article. Moreover, there has not been any single sheet of material which is foldable and which has embossed segments on the exterior surface which highlight and cooperate with the design on the exterior surface and which is also capable of being folded to provide a three-dimensional display device.

More specifically, there has not been any three-dimensional display device which has a flag design on the exterior surface and with the flag design conforming to and cooperating with the contour of the device to create a unique appearance. In addition, there has not been any such three-dimensional display device in which the flag design has embossed segments conforming to and cooperating with the design to create a unique appearance in a single sheet which is capable of being folded into a three-dimensional display device. Further, there has not been any such three-dimensional device which is folded from a single sheet of paper or paperboard material where the sheet of material, in and of itself, serves as a poster or similar single sheet display object.

OBJECTS OF THE INVENTION

It is, therefore, one of the primary objects of the present invention to provide a sheet of foldable material having a design on its surface and which can be folded into a three-dimensional device with the design conforming to and cooperating with the contour of the three-dimensional device thus formed.

It is another object of the present invention to provide a three-dimensional display device having a design on its exterior surface and which conforms to and generally cooperates with the surface contour of the device to provide a unique appearance and configuration.

It is a further object of the present invention to provide a sheet of material of the type stated which is highly effective in serving as a single sheet decorative display art object and which when folded into a three-dimensional device, provides a unique outer design on the three-dimensional device.

It is still a further object of the present invention to provide a single sheet of material of the type stated which has embossed segments thereon cooperating with segments of a design thereon and which can be folded into a three-dimensional display device having a unique outer surface appearance thereon.

It is also an object of the present invention to provide a sheet of material of the type stated having a design of a flag on the surface thereof and which can be folded into a three-dimensional display device with the flag on the surface of the device and with embossed segments on certain portions of the flag cooperating with and corresponding to contours of the three-dimensional display device.

It is an additional object of the present invention to provide a three-dimensional display device of the type stated which is highly effective as a craft device for both children and adults and which can be produced at a relatively low unit cost.

It is still another object of the present invention to provide a method of making a three-dimensional display device from a single sheet of foldable material and which sheet of material provides a design on its exterior surface and which forms part of and conforms to a surface contour of the display device thus formed.

With the above and other objects in view, my invention resides in the novel features of form, construction, arrangement and combination of parts presently described and pointed out in the claims.

BRIEF SUMMARY OF THE DISCLOSURE

Generally speaking, the present invention relates to a single sheet of foldable material having a design on an exterior surface and which can be folded or otherwise formed into a three-dimensional display device having that design conforming to and cooperating with the contour of the device thus formed. In a preferred embodiment, the single sheet of material is capable of functioning as a single sheet object, such as a poster, or the like, and which when folded, will serve as a three-dimensional art object or as a utilitarian object having other purposes.

The single sheet of foldable material in accordance with the present invention is preferably provided with a plurality of fold lines such that the sheet of material can be folded into the three-dimensional display device. These fold lines usually comprise a first set of generally parallel horizontally extending fold lines and a second set of generally parallel vertically disposed fold lines.

The single sheet of foldable material is provided with embossed sections on its exterior surface and which embossed sections also conform to and cooperate with the design. In essence, these embossed sections highlight certain portions of the design. The sheet of material is provided with a score line around the peripheral area of the design such that portions of the sheet of material beyond the design can be removed when it is desired to fold and assemble the sheet of material into a three-dimensional display device. If desired, score lines can also be provided for removing other portions of the sheet of material which are not necessary to complete the three-dimensional display device, or otherwise, to create a further unique surface appearance, or a surface contour therefor.

The plurality of horizontal fold lines enables the sheet to be folded into a front wall and a back wall along with a top closure panel and a bottom closure panel. The vertically disposed fold lines enable the sheet to be folded into a pair of end walls, with one of the end wall sections being located initially on the front wall and the other of the end wall sections being initially hingedly located on the back wall. Moreover, tabs are formed on each of the end walls for securement to the associated back and front walls and to at least one of the top or bottom closure panels.

When the sheet of material is folded into a three-dimensional display device, the embossed sections will cooperate with the design and enhance the design. Moreover, the design is arranged so that it cooperates with the surface contour of the three-dimensional display device thus formed. The embossed sections of the design will extend beyond the non-embossed sections of the design, providing a unique surface appearance to the article.

This invention possesses many other advantages and has other purposes which may be made more clearly apparent from a consideration of the forms in which it may be embodied. These forms are shown in the drawings forming part of and accompanying the present specification. They will now be described in detail for purposes of illustrating the general principles of the invention, but it is to be understood that such detailed description is not to be taken in a limiting sense.

BRIEF DESCRIPTION OF THE DRAWINGS

Figure 1:
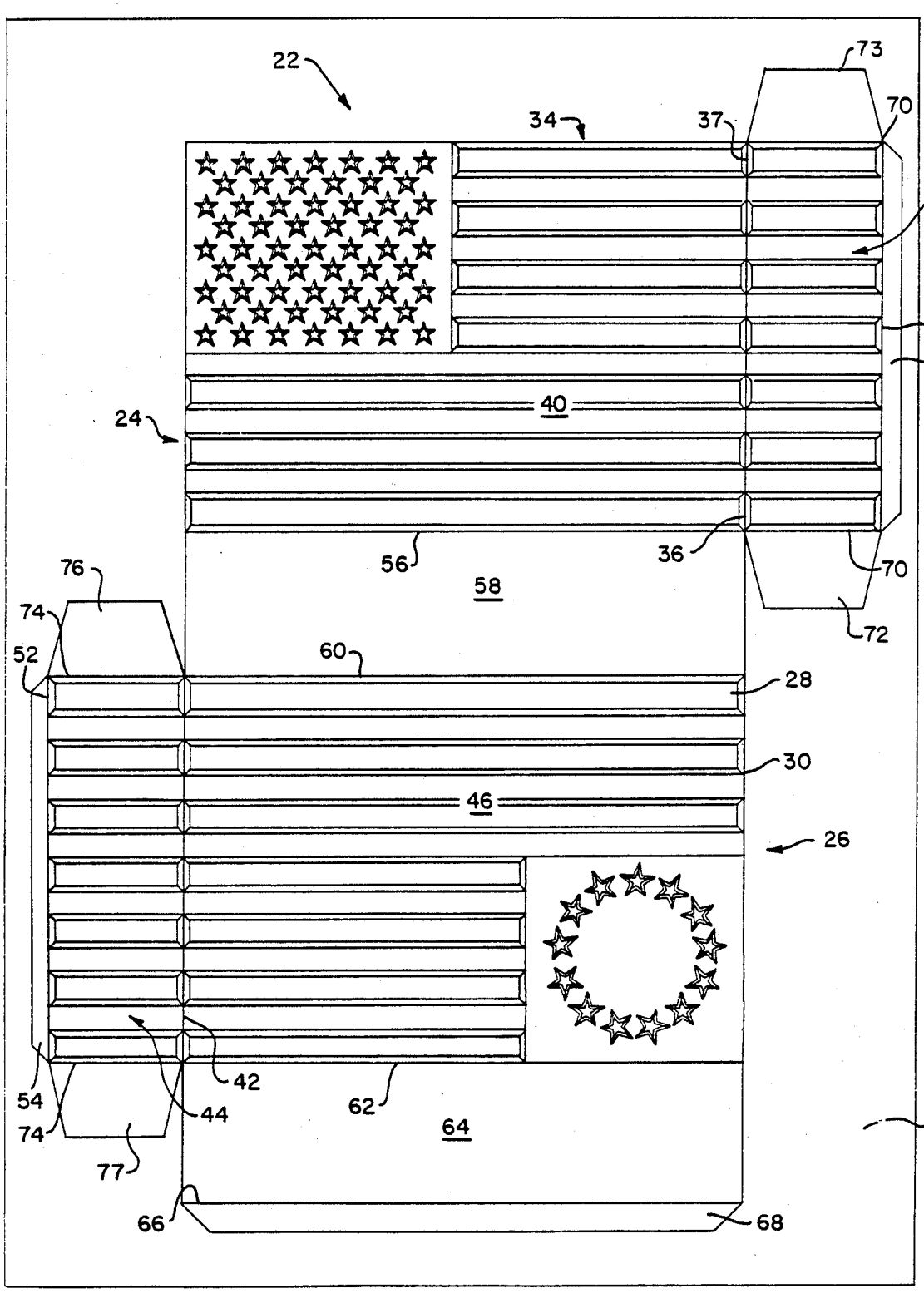
Figure 2:
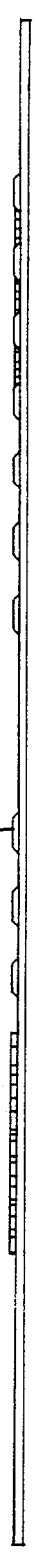
Figure 3:
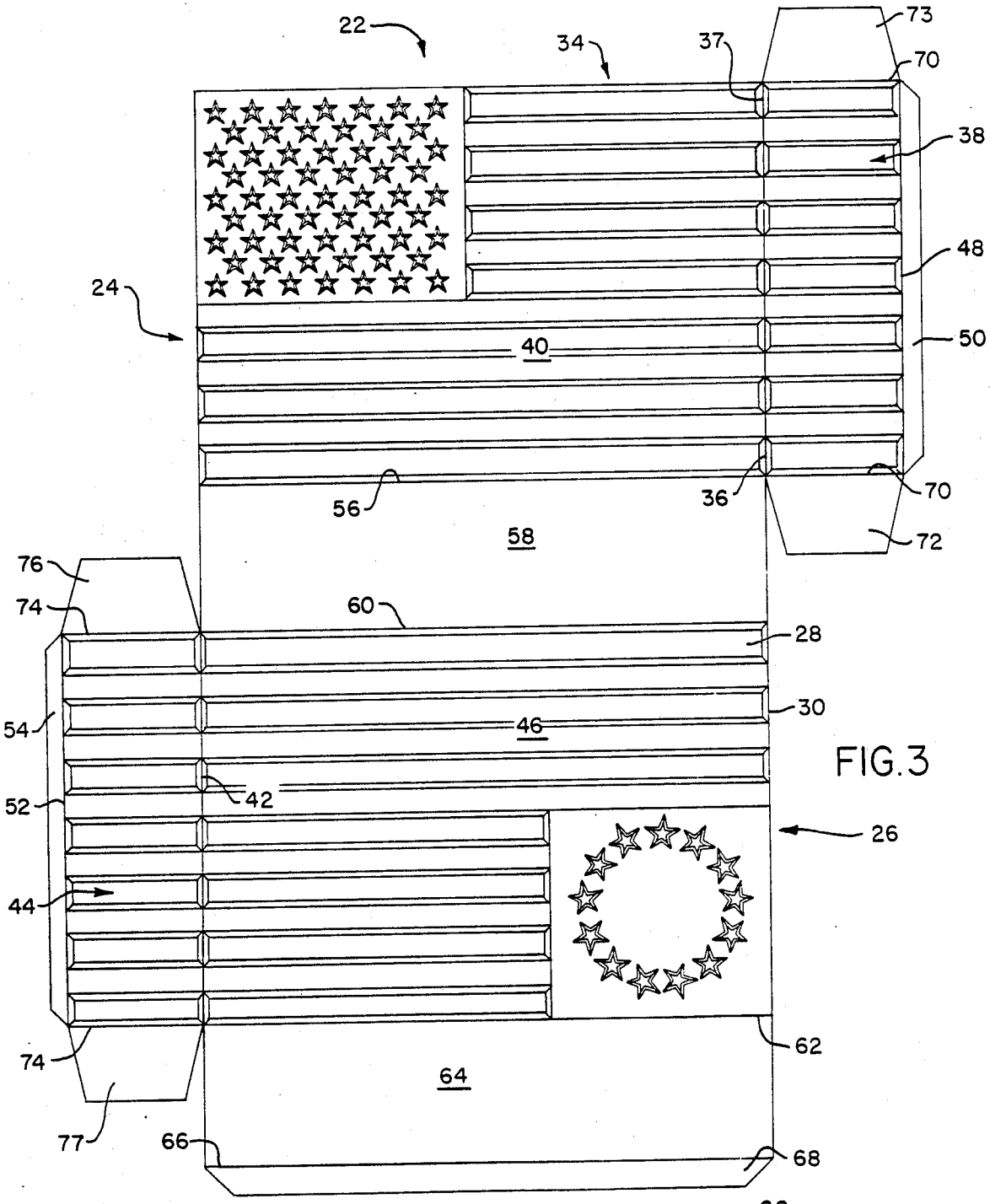
Figure 4:
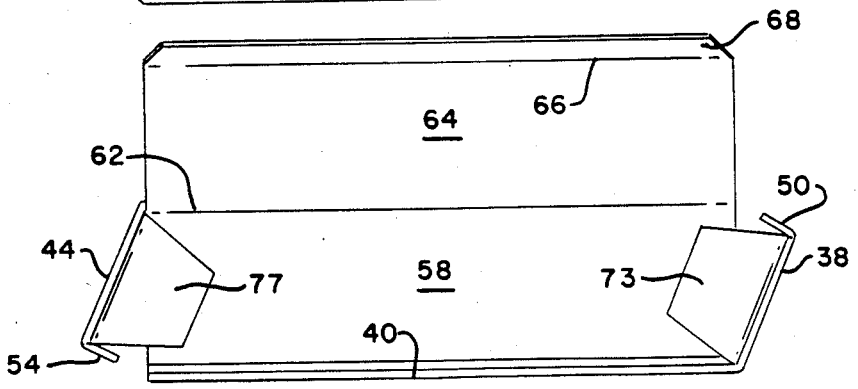
Figure 5:
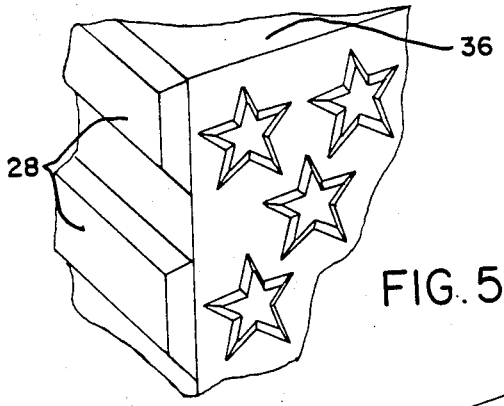
Figure 6:
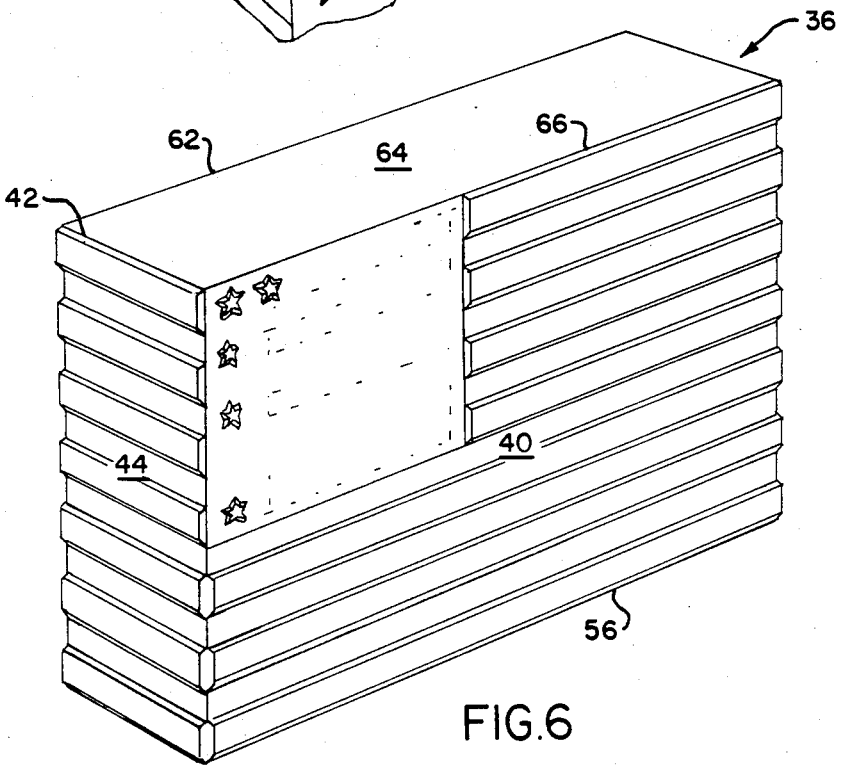
Figure 7:
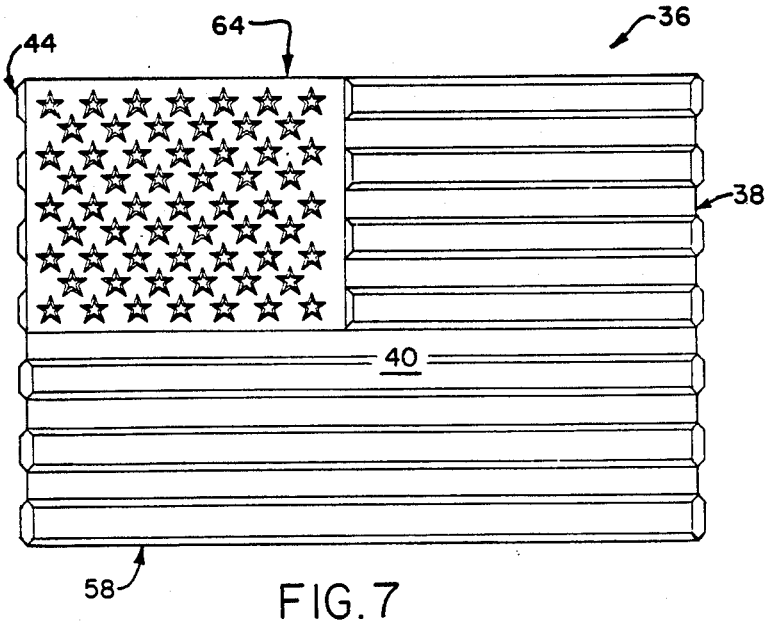

Having thus described the invention in general terms, reference will now be made to the accompanying drawings (three sheets) in which:

FIG. 1 is a front elevational view of a sheet of material which may be folded to form the three-dimensional display device of the present invention;

FIG. 2 is an end elevational view of the sheet of material of FIG. 1;

FIG. 3 is a front elevational view of the sheet of material of FIG. 1 with peripheral portions removed to form an outline of a display member capable of being folded into the three-dimensional display device;

FIG. 4 is a top plan view of the display member of FIG. 1 showing the positional relationship of components forming part of the display member in an intermediate stage when being assembled to form the three-dimensional display device;

FIG. 5 is a fragmentary perspective view showing a portion of a corner of the three-dimensional display device when the latter has been assembled;

FIG. 6 is a perspective view of the completed three-dimensional display device which may be formed from the sheet of material of FIG. 1 and the display member of FIG. 3;

FIG. 7 is a front elevational view of the display device of FIG. 6; and

Figure 8:
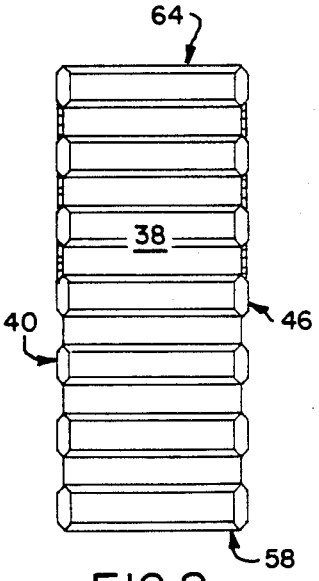

FIG. 8 is an end elevational view of the display device of FIG. 7.

DETAILED DESCRIPTION OF A PREFERRED EMBODIMENT

Referring now in more detail and by reference characters to the drawings, 20 designates a sheet of material which has a design 22 on the front surface thereof. In this embodiment, the design includes a first design portion 24 showing portions of the present American flag and a second design portion 26 showing portions of the so-called "Betsy Ross" American flag.

The design on the sheet of material can vary widely, the primary criteria being that the design should conform to and cooperate with the surface contour of the three-dimensional display device, as hereinafter described in more detail. Thus, in a preferred embodiment, the design should have horizontal sections which, for example, can represent the stripes of the American flag.

In each case, the first design portion 24 and the second design portion 26 both include sections containing stars along with alternating red and white stripes. The stripes will ultimately conform to and identify individual segments on wall sections of the three-dimensional display device when formed. In this respect, designs other than flags could be employed on the surface of the sheet of material 20. For example, the design could include rows of bricks, or logs forming part of a log cabin, since they would, in effect, define horizontal sections which would conform to and partially define a contour of a three-dimensional object.

The front surface of the sheet of material 20 is embossed to provide individual horizontally extending embossed segments 28, as best illustrated in FIG. 2 of the drawings. These embossed segments 28 will literally conform to and form part of the design 22 on the front face. More specifically, the embossed segments 28 will represent either the alternating red and white stripes on the first design portion 24 and on the second design portion 26. In the preferred embodiment, the portions representing the red stripes are embossed. The embossment may be created by any conventional embossing technique. Moreover, the term "embossed" with reference to the present invention, is used in a generic sense to include any kind of raised surface contour.

The sheet of material of FIG. 1 may serve as an art object, as aforesaid, and is capable of being used as a wall hanging poster or like wall covering material. In this connection, the sheet of material can be framed or otherwise mounted and displayed.

The sheet of material 20 is preferably formed of a paper or paperboard material. When formed of a paper material, it should be formed of a fairly thick sheet material so as to have some body thereto. For example, a heavy Kraft-type paper would be suitable for this purpose. More preferably, the sheet of material should be formed from a suitable light-weight paperboard material, or so-called "cover stock" material. The sheet of material should have sufficient body so as to resist undue wrinkling and an inadvertant creation of folds therein, but it should nevertheless be capable of being folded along fold lines (hereinafter described) which are formed in the sheet of material 20.

In another embodiment of the invention, the sheet of material 20 could be formed of a thin plastic material, as for example, a foamable polystyrene. In this case, the sheet of polystyrene material could be selectively foamed in the area where embossed sections are to be produced. These raised foamed portions would therefore constitute the embossed sections.

The term "fold lines", as used in the present invention, represent regions which may have been ruled or areas of reduced thickness such as lines of reduced thickness, enabling the sheet material to be folded. The score lines, on the other hand, represent portions either of reduced thickness or having scores therein such that they may be easily severed or cut. For example, one suitable score may be a series of sequential pin holes formed through the sheet of material. Otherwise, the score line may have areas of reduced thickness capable of being easily severed and include die-cut regions and the like. The term "fold lines" will also be deemed to include score lines, as well, except where score lines are separately designated.

The sheet 20 is provided with a peripheral design score line 30 which extends around the entire periphery of the design 22 on the sheet 20. This score line 30 defines an outer peripheral section 32 of the sheet material 20 which may be removed to thereby produce a display member 34 (as illustrated in FIG. 3) formed in the sheet material and which has a periphery conforming only to the design 22 on the sheet 20. The removal of the peripheral section 32 from the sheet 20 contitutes the first step in forming a three-dimensional display device 36, which is more fully illustrated in the perspective view of FIG. 6.

The sheet of material 20 is also provided with a first vertically disposed fold line 37 which is capable of being folded to form a right end wall 38, initially hingedly located on a front wall 40, as shown in FIG. 3. The sheet 20 is also provided with a second vertically disposed fold line 42 which is capable of forming a left end wall section 44, initially hingedly located on a back wall 46. A third vertical fold line 48 is provided for folding a securement tab 50 on the outermost edge of the end wall section 38. Finally, a vertically disposed fold line 52 is provided for folding a tab 54 on the left end wall section 44. These tabs 50 and 54 function as securement tabs for securement to the respective back and front walls. Thus, the tab 50 is adapted for securement to the back wall section 46 and the tab 54 is adapted for securement to the interior surface of the front wall section 40.

The sheet of material 20 is also provided with a plurality of horizontally extending fold lines, as best illustrated in FIGS. 1 and 3 of the drawings. These horizontal fold lines comprise a first horizontal fold line 56 which is capable of folding the front wall section 40 with respect to a bottom wall, or a so-called bottom closure panel 58. A second horizontally extending fold line 60 is provided for folding the back wall 46 with respect to the "bottom closure panel" 58 in the manner as illustrated in FIG. 1. A third horizontally extending fold line 62 is provided, as illustrated in FIG. 4, for enabling the folding of a top flap or so-called "top closure panel" with respect to both the front wall 40 and the back wall 46 when the sheet is assembled into the three-dimensional display device. An additional horizon- tally extending fold line 66 is located on the top flap 64 to provide an in-turned tab 68 and which is capable of being disposed within the three-dimensional display device, when folded, and snugly engages the interior surface of the front wall 40 to hold the top closure panel 64 in a closed position.

The sheet of material 20 is also provided with additional fold lines 70 in the right end wall section 38 to thereby form a bottom securement flap 72 and an upper flap 73. In like manner, the left end wall section 44 is provided with horizontally extending fold lines 74 to provide a bottom securement flap 76 and an upper flap 77.

To assemble and form the three-dimensional display device, the various components are folded along the fold lines as shown. Thus, the front wall 40 is folded to a position where it is perpendicularly located with respect to the bottom wall 58 and in parallel arrangement with respect to the back wall 46. In like manner, the end wall sections 38 and 44 are folded to positions where they are perpendicularly arranged with respect to the front wall 40 and the back wall 46 and are parallel to one another. Moreover, the top panel 64 is folded to a position where it is disposed in generally parallel arrangement to the bottom closure panel 58.

The lowermost securement flap 72 on the right end wall section 38 is then secured to the interiorly present surface of the bottom closure panel 58 by means of any suitable adhesive, or the like. In addition, the securement flap 76 on the left end wall section 44 is similarly adhesively secured to the interiorly presented surface of the bottom closure panel 58. Moreover, the vertically disposed flap 54 is adhesively secured to the interiorly presented surface of the front wall 40 at a point where the left end wall section becomes adjacent to the front wall 40. Furthermore, the vertically disposed securement flap 50 on the right end wall section 38 is adhesively secured to the interiorly presented surface of the back wall 46 in the region where the end wall section 38 is perpendicularly arranged to and adjacent to the back wall 46.

At this point in the process, the three-dimensional display device has been formed. The top wall can be removeably disposed over the open upper end in order to close and also provide access into the interior of the device. Moreover, the other of the flaps 73 and 77 remain as in-turned tabs to extend beneath the top closure panel 64 when the latter is folded to the closed position over the three-dimensional display device thus formed.

By further reference to FIGS. 5–8 of the drawings, it can be observed that the embossed sections are alternately located with respect to the non-embossed sections. Moreover, the embossed sections represent either the red or white stripes of the American Flag, with the non-embossed sections representing the other of the red or white stripes of the American Flag. Thus, each embossed red section, for example, will alternate with each non-embossed white section, thereby providing alternating red and white stripes, with the red stripes projecting outwardly from the surface of the white stripes. When the various walls and flaps of the display member 34 are initially folded in the manner as illustrated and described, they will begin to assume a configuration somewhat similar to that illustrated in FIG. 4. When the various flaps are secured to one another, as described, the finally secured walls and flaps will assume a configuration as best illustrated in FIGS. 5–8 of the drawings to provide the completed display device.

When the display device has been assembled, it can readily function as a utilitarian object and is provided with an interior cavity or chamber. Thus, the display device is then capable of being used for storage or retention of objects in this interior chamber.

It can be observed that the initial sheet of material which is capable of being folded into a three-dimensional display device is highly effective as a craft for both children and adults, or as a game device. Moreover, depending upon the material from which the sheet is made, it also functions as a highly durable and highly effective display device. It can be observed that the stripes which form part of the American flag literally cooperate with the overall aesthetic appearance and construction of the display object. For example, the red stripes protrude beyond the white stripes. Thus, there is a clear physical three-dimensional demarcation between the red and white stripes.

It should be understood that other designs could be imprinted on the surface of the sheet of material 20 in order to render a different aesthetic appearance to the display device. However, it is preferable to employ designs which have band sections corresponding to the actual bands forming part of the exterior wall surface of the display device.

Thus there has been illustrated and described a unique and novel display device comprising a sheet of material which is capable of being folded into a three-dimensional display device and containing a design which conforms to and co-acts with the exterior surface contour of the display device. Thus, the present invention fulfills all of the objects and advantages which have been sought. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described my invention, what I desire to claim and secure by letters patent is:

1. A decorative display device having a design on a face thereof capable of use as a relatively flat suspendable poster and capable of being folded to a three-dimensional display object, said display device comprising:

(a) a flat sheet of foldable material initially having a front face with upper and lower edges and a pair of spaced apart side edges, (b) a design on the front face allowing the device to be suspended in the position of a poster and said design being characterized by a plurality of individual design elements, and some of said design elements being generally horizontally extending design elements, (c) a plurality of first fold lines extending across said sheet generally between said spaced apart side edges forming individual segments which extend between said side edges and at least certain of said segments being generally horizontally extending and corresponding to certain of the individual design elements, (d) embossed portions on certain of said horizontally extending individual segments and which portions extend outwardly beyond and on opposite horizontal sides of other of said generally horizontally extending segments, said embossed portions corresponding to certain of said design elements and cooperating with said design elements to provide a design with a three-dimensional effect, and (e) a plurality of second fold lines extending between the upper and lower edges of said sheet permitting folding of said sheet into spaced apart front and back walls and spaced apart side walls forming a three-dimensional continuous shell with a interior cavity and which is initially open at its upper or lower end.

2. The decorative display device of claim 1 further characterized in that one of said first fold lines extends between said side edges forming a closure panel which is integral with and bendable to an edge of one of said walls, said closure panel capable of being bent to be disposed over an end thereby enclosing said continuous shell and forming a three-dimensional display device.

3. The decorative display device of claim 1 further characterized in that said second fold lines are generally perpendicular to said first fold lines.

4. The decorative display device of claim 1 further characterized in that said embossed portions on said horizontally extending segments have non-embossed sections in the region of said second fold lines to enable folding of the horizontally extending segments about said second fold lines.

5. The decorative display device of claim 1 further characterized in that embossed portions on certain of said horizontally extending segments extend outwardly beyond certain of the other of said horizontally extending segments on the exterior surfaces of said walls such that there is somewhat of a corrugated surface appearance.

6. The decorative display device of claim 5 further characterized in that the horizontally extending segments with the embossed portions alternate with the horizontally extending segments that are not embossed.

7. The decorative display device of claim 6 further characterized in that when said three-dimensional display device is formed, certain of the segments in certain of the walls of said display device and therefore certain elements of the design have a dimension which is less than other of the segments and associated design elements in that wall.

8. A three-dimensional decorative display device formed from a single sheet of foldable material having a plurality of first fold lines therein, said display device comprising;

(a) a plurality of endwise connected wall sections forming an enclosing wall with initially open portions of the display device, (b) a first closure panel integrally connected to at least one of said spaced apart wall sections to close one open portion of said display device, (c) a second closure panel hingedly and integrally connected to another wall section and folded over to close another portion of the display device to form a completely enclosed three-dimensional display device, (d) each of said wall sections in said single sheet having generally parallel first fold lines arranged so that when folded each of the wall sections on said enclosing wall have lengthwise extending segments, (e) a design on at least certain of the wall sections and said design being characterized by a plurality of individual design elements, and some of said design elements being generally horizontally extending design elements, (f) said plurality of first fold lines extending across said certain of the wall sections forming individual segments which extend across said certain of the wall sections and at least certain of said segments being generally horizontally extending and corresponding to certain of the individual design elements, and, (g) embossed portions on certain of said horizontally extending individual segments and which embossed portions extend outwardly beyond and on opposite horizontal sides of other of said generally horizontally extending segments, said embossed portions corresponding to certain of said design elements and cooperating with said design elements to provide a design on said three-dimensional object with a three-dimensional effect and also providing each wall section with a somewhat corrugated shape.

9. The decorative display device of claim 8 further characterized in that the said wall also has a plurality of second fold lines arranged so that when folded, certain of said segments in each of said wall sections have a lengthwise dimension which is less than other of said segments in that wall section.

10. The decorative display device of claim 9 further characterized in that said first fold lines are arranged so that certain of the lengthwise extending segments have a length greater than certain of other alternating segments in each of said wall sections.

11. The decorative display device of claim 8 further characterized in that alternating embossed lengthwise extending segments which have embossed portions are separated by nonembossed lengthwise extending segments.

12. The decorative display device of claim 11 further characterized in that certain of the corresponding segments in each wall section have a lengthwise direction greater than each next adjacent alternating segment so that in the final display device, alternating segments of greater length are separated by alternating segments of lesser length.

13. The decorative display device of claim 8 further characterized in that said first fold lines extend generally horizontally across said sheet and said plurality of second fold lines extending generally vertically on said sheet.

14. The decorative display device of claim 13 further characterized in that said second fold lines intersect certain of said first fold lines and define opposite edges of the segments in each wall section.

15. The decorative display device of claim 14 further characterized in that a plurality of third fold lines are formed in said wall sections so that when a three-dimensional display device is formed, certain of said segments in a wall section forming part of the display device have inwardly or outwardly extending portions on said segments.

16. A sheet of material capable of being suspended or hung for use as a poster when in a flat sheet form and capable of being folded and assembled into a three-dimensional display device, said sheet of material comprising:

(a) a design on a front flat face of said sheet and having a plurality of horizontally extending design elements, (b) a plurality of horizontally extending fold lines dividing said sheet into a front wall section and a back wall section with one of said front and back wall sections being initially located above the other, (c) certain of said horizontally extending fold lines defining horizontally extending segments in said sheet and certain of the segments having embossed portions thereon so that the surfaces of said embossed portions protrude outwardly beyond other segments which do not have embossed portions, said embossed portions corresponding to certain of said design elements and cooperating with said design elements to provide a design with a three-dimensional effect, (d) a plurality of vertically disposed fold lines dividing said sheet into one end wall section on the side edge of one of said front or back wall sections and another end wall section on the side edge of the other said front or back wall sections and being diagonally located on said sheet with respect to the first of the end wall sections, (e) certain of said plurality of horizontally extending fold lines dividing said sheet into a plurality of horizontally disposed segments extending through said front and back wall sections and each of said end wall sections, said horizontally disposed design elements arranged with respect to and corresponding with said horizontally disposed segments and said embossed portions arranged with respect to said horizontally disposed segments to further produce a design with a three-dimensional effect, certain of said horizontally extending fold lines also dividing said sheet into top and bottom wall sections capable of extending between said front and back wall sections when said sheet is folded into the three-dimensional objects, and (f) portions of certain of said horizontally extending fold lines and portions of certain of said vertically extending fold lines being score lines extending about the design on the front flat face of the sheet so that portions of said sheet beyond such design can be removed leaving substantially only the design.

17. The sheet of claim 16 further characterized in that alternating ones of said horizontally disposed segments with embossed portions in the front and back wall sections have a length which is longer than the other of said horizontally disposed segments in said front and back wall sections.

18. The sheet of claim 17 further characterized in that when said three-dimensional display device is formed, the embossed portions in the end wall sections have a length which is greater than the others of the segments in said end wall sections.

* * * * *